US010925458B2

(12) United States Patent
Youdovin

(10) Patent No.: US 10,925,458 B2
(45) Date of Patent: Feb. 23, 2021

(54) FLOOR CLEANING DEVICE

(71) Applicant: Butler's Brand, Inc., New York, NY (US)

(72) Inventor: David N. Youdovin, New York, NY (US)

(73) Assignee: Butler's Brand, Inc., New York, NY (US)

( * ) Notice: Subject to any disclaimer, the term of this patent is extended or adjusted under 35 U.S.C. 154(b) by 0 days.

(21) Appl. No.: 16/555,577

(22) Filed: Aug. 29, 2019

(65) Prior Publication Data

US 2020/0383551 A1 Dec. 10, 2020

Related U.S. Application Data

(60) Provisional application No. 62/857,450, filed on Jun. 5, 2019.

(51) Int. Cl.
*A47L 13/26* (2006.01)
*A47L 13/42* (2006.01)

(52) U.S. Cl.
CPC ..... *A47L 13/26* (2013.01); *A47L 13/42* (2013.01)

(58) Field of Classification Search
CPC .. A47L 13/22; A47L 13/26–316; A47L 13/42; A47L 11/4083; A47L 11/125; A47L 11/161; A47L 11/1625; A47L 11/325; A47L 11/34; A46B 11/001; A46B 11/0055; A46B 11/0017; B05B 11/0054
(Continued)

(56) References Cited

U.S. PATENT DOCUMENTS 2,053,282 A * 9/1936 Gewalt ..... A47L 13/312 401/138
2,655,286 A 10/1953 Barbaro
(Continued)

FOREIGN PATENT DOCUMENTS

KR 20-0459769 Y1 4/2012
KR 2014-0004697 U 8/2014

OTHER PUBLICATIONS

International Searching Authority, International Search Report and Written Opinion for International Application No. PCT/US2019/048770, dated Mar. 4, 2020, (10 pages), Korean Intellectual Property Office, Republic of Korea.
(Continued)

*Primary Examiner* — Paul R Durand
*Assistant Examiner* — Randall A Gruby
(74) *Attorney, Agent, or Firm* — Alston & Bird LLP

(57) ABSTRACT

According to an aspect of the present invention, a floor cleaning device is provided. In an example embodiment, the floor cleaning device comprises a rod, the rod extending between a proximate end and a distal end; a handle comprising a trigger secured to the proximate end of the rod; a cleaning head secured to the distal end of the rod; a nozzle disposed proximate the distal end of the rod; and a cleaning solution dispensing unit secured to the rod between the proximate end and the distal end. The cleaning solution dispensing unit comprises a housing comprising a capsule chamber configured to receive a cleaning capsule therein. When the trigger is activated, cleaning solution is dispensed through the nozzle via a dispensing tube extending from the cleaning solution dispensing unit to the nozzle.

19 Claims, 4 Drawing Sheets

Figure 1:
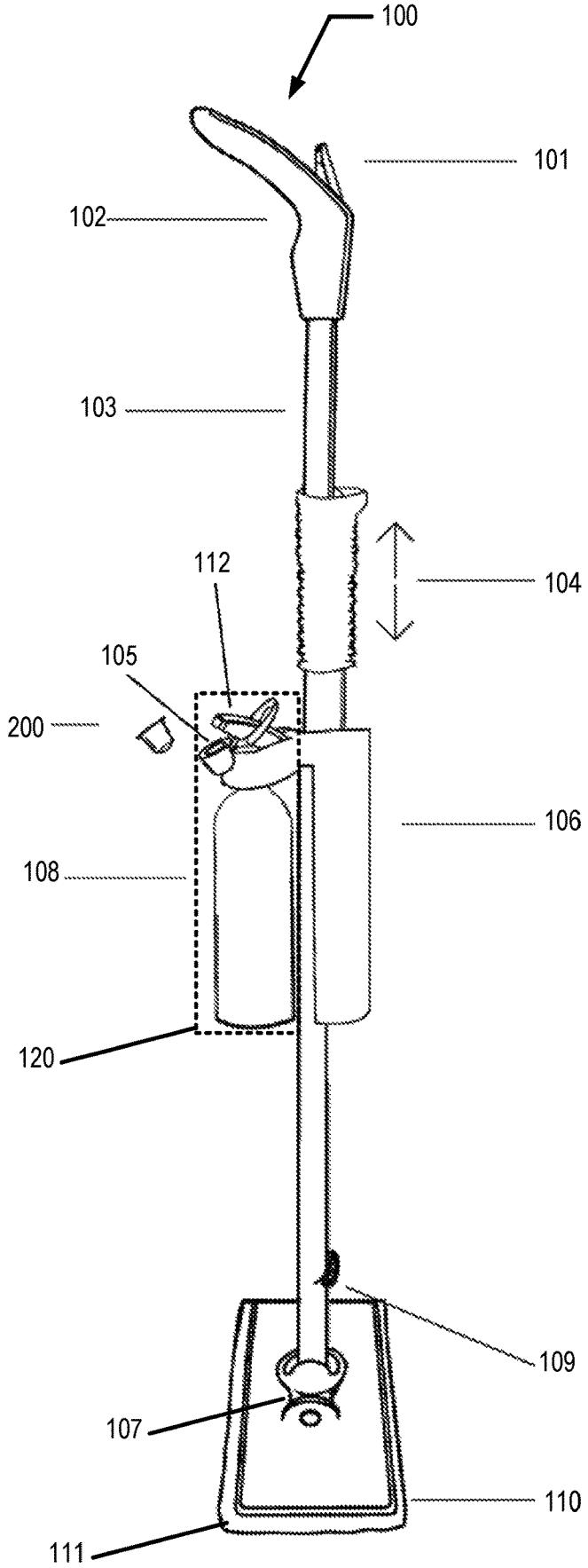

(58) Field of Classification Search
USPC ..... 401/38–39, 138–140
See application file for complete search history.

(56) References Cited

U.S. PATENT DOCUMENTS 3,092,293 A * 6/1963 Helm ..... A47L 11/1625 222/481
3,094,152 A * 6/1963 Kenny ..... A47L 11/161 141/19
3,453,058 A * 7/1969 Bixel ..... A47L 13/30 401/188 R
3,655,096 A 4/1972 Easter
3,713,744 A * 1/1973 Sims ..... A47L 13/22 401/9
3,966,089 A 6/1976 Klingaman
4,044,989 A * 8/1977 Basel ..... F16K 7/06 251/7
4,112,538 A * 9/1978 Bates ..... A47L 11/4016 15/321
4,355,739 A 10/1982 Vierkotter
4,618,076 A 10/1986 Silvenis
4,863,299 A * 9/1989 Osberghaus ..... A47L 13/22 401/15
D314,916 S 2/1991 Brooks
5,056,685 A 10/1991 Wild
5,364,198 A * 11/1994 Skenderi ..... A47L 1/08 401/138
5,371,912 A * 12/1994 Hall ..... A47L 11/125 15/50.1
5,397,029 A 3/1995 West
5,657,910 A 8/1997 Keyser
5,836,479 A 11/1998 Klima et al.
5,887,761 A 3/1999 Foster et al.
5,964,377 A 10/1999 Demarest et al.
6,041,969 A 3/2000 Parise
6,101,671 A * 8/2000 Wright ..... A47L 5/24 15/119.2
6,152,326 A 11/2000 Klima, Jr. et al.
D435,792 S 1/2001 Peloquin
6,394,683 B1 * 5/2002 Pao ..... A47L 13/22 401/137
6,497,525 B1 * 12/2002 Huang ..... A47L 13/22 401/137
6,655,866 B1 * 12/2003 Morad ..... A47L 13/22 401/137
6,854,912 B2 * 2/2005 Dyer ..... A47L 13/22 401/131
6,997,351 B2 2/2006 Cho
7,163,130 B2 1/2007 Lafond
8,157,131 B2 4/2012 Sim
8,235,310 B2 8/2012 Birrenkott et al.
8,241,427 B1 * 8/2012 Crawford ..... B25G 1/102 134/6
8,261,943 B2 9/2012 Sim
8,281,960 B1 10/2012 Gers
8,528,784 B2 9/2013 Sim
9,028,457 B2 5/2015 Leach et al.
9,533,331 B1 1/2017 Kane et al.
9,987,645 B2 6/2018 Richman et al.
2001/0006588 A1 * 7/2001 Zorzo ..... A47L 13/22 401/137
2002/0020720 A1 2/2002 Schmid et al.
2002/0092116 A1 7/2002 Zahuranec et al.
2003/0103795 A1 * 6/2003 Hollars ..... A47L 13/225 401/138
2005/0224515 A1 10/2005 Mon et al.
2006/0086759 A1 4/2006 Herzog
2006/0140703 A1 6/2006 Sacks
2006/0196885 A1 9/2006 Leach et al.
2008/0001002 A1 1/2008 Garon
2008/0099058 A1 5/2008 Santoemma et al.
2008/0314928 A1 12/2008 Banco et al.
2009/0095822 A1 4/2009 Chen et al.
2009/0212077 A1 8/2009 Carden
2009/0277928 A1 11/2009 Brückner
2010/0024834 A1 2/2010 Oglesby et al.
2010/0040489 A1 * 2/2010 Rosenzweig ..... F04B 43/1253 417/412
2010/0096414 A1 4/2010 Dennis
2010/0206903 A1 8/2010 Banco et al.
2011/0174837 A1 7/2011 Nelson et al.
2011/0236002 A1 9/2011 Oglesby et al.
2013/0193232 A1 8/2013 Dobias et al.
2013/0340798 A1 * 12/2013 Perelli ..... B65D 1/06 134/198
2015/0352571 A1 12/2015 Petkus et al.
2019/0274514 A1 * 9/2019 Leao ..... B05B 11/3057

OTHER PUBLICATIONS

International Searching Authority, International Search Report and Written Opinion for International Application No. PCT/US2019/048766, dated Feb. 27, 2020, (9 pages), Korean Intellectual Property Office, Republic of Korea.

* cited by examiner

FLOOR CLEANING DEVICE

CROSS-REFERENCE TO RELATED APPLICATIONS

This application claims priority to U.S. Application No. 62/857,450, filed Jun. 5, 2019, the content of which is hereby incorporated by reference in its entirety.

BACKGROUND

Various tools exist for the cleaning of surfaces such as floors. Some of these tools utilize cleaning solutions to assist in said cleaning. Such spray cleaning devices often include containers that contain cleaning liquid. This liquid is sprayed out of the cleaning device onto the ground using a battery operated spray device. Generally, when the cleaning liquid reservoir is empty, the entire reservoir is replaced with a new reservoir containing cleaning liquid. Thus, such floor cleaning tools lead to a significant amount of waste (e.g., empty reservoirs, old batteries). Furthermore, it is difficult to change the type of cleaning liquid (from a wood floor cleaner to a tile floor cleaner, for example).

BRIEF SUMMARY

Example embodiments of the present invention provide a floor cleaning device that uses mechanical action to pressurize a reservoir containing cleaning solution such that the cleaning solution may be sprayed onto the floor (e.g., via user activation of a trigger). Example embodiments provide a swiveling head that uses a material to clean floors by utilizing said material and the cleaning solution. Example embodiments of the present invention include cleaning capsules that are punctured upon insertion into the cleaning device. Said capsules contain a concentrated cleaning liquid. Example embodiments contain a reservoir that can be filled with a dilution chemical (e.g., water, vinegar, and/or the like) and attached to the cleaning device. Example embodiments of the invention allow the dilution chemical and concentrated cleaning liquid to mix within the reservoir to form a cleaning solution. Example embodiments of the present invention contain a mechanism to build up air pressure within the reservoir. Said mechanism will pressurize the cleaning solution (e.g., cleaning liquid/dilution chemical mixture) and allow it to be sprayed out of the cleaning device.

According to one aspect of the present invention, a floor cleaning device that can spray a cleaning solution (e.g., without the use of batteries) is provided. In an example embodiment, said cleaning device comprises a handle that is attached to a rod. Said handle also comprises a trigger. In an example embodiment, said cleaning device also comprises a pump handle that is affixed to the rod and is capable of movement along a portion of a length of the rod. Example embodiments have a mechanism that compresses air (e.g., through the movement of the pump handle along the portion of the length of the rod). Example embodiments have a removable reservoir that can carry dilution chemical (e.g., water, ionized water, filtered water, tap water, vinegar, and/or the like), cleaning liquid, and/or cleaning solution (e.g., a mixture of dilution chemical and cleaning liquid). Example embodiments provide a capsule chamber reservoir to hold cleaning capsules. The apparatus also comprises a way to puncture the cleaning capsules and a lid to the chamber reservoir. When the capsule is positioned within the capsule chamber and the lid is closed, the capsule is punctured, and cleaning solution is provided to the reservoir. Example embodiments provide outlet tubing that connects the reservoir to the cleaning device head. Example embodiments also comprise a spray nozzle and/or atomizer nozzle located on or near the head of the cleaning device. When the trigger is pushed, the pressurized cleaning solution goes through the tubing and leaves the cleaning device through the spray nozzle.

According to an aspect of the present invention, a floor cleaning device is provided. In an example embodiment, the floor cleaning device comprises a rod, the rod extending between a proximate end and a distal end; a handle comprising a trigger secured to the proximate end of the rod; a cleaning head secured to the distal end of the rod; a nozzle disposed proximate the distal end of the rod; and a cleaning solution dispensing unit secured to the rod between the proximate end and the distal end. The cleaning solution dispensing unit comprises a housing comprising a capsule chamber configured to receive a cleaning capsule therein. When the trigger is activated, cleaning solution is dispensed through the nozzle via a dispensing tube extending from the cleaning solution dispensing unit to the nozzle.

BRIEF DESCRIPTION OF THE OF THE DRAWING

Having thus described the invention in general terms, reference will now be made to the accompanying drawings, which are not necessarily drawn to scale, and wherein:

FIG. 1 provides a side view of a floor cleaning device, in accordance with an example embodiment.

Figure 2:
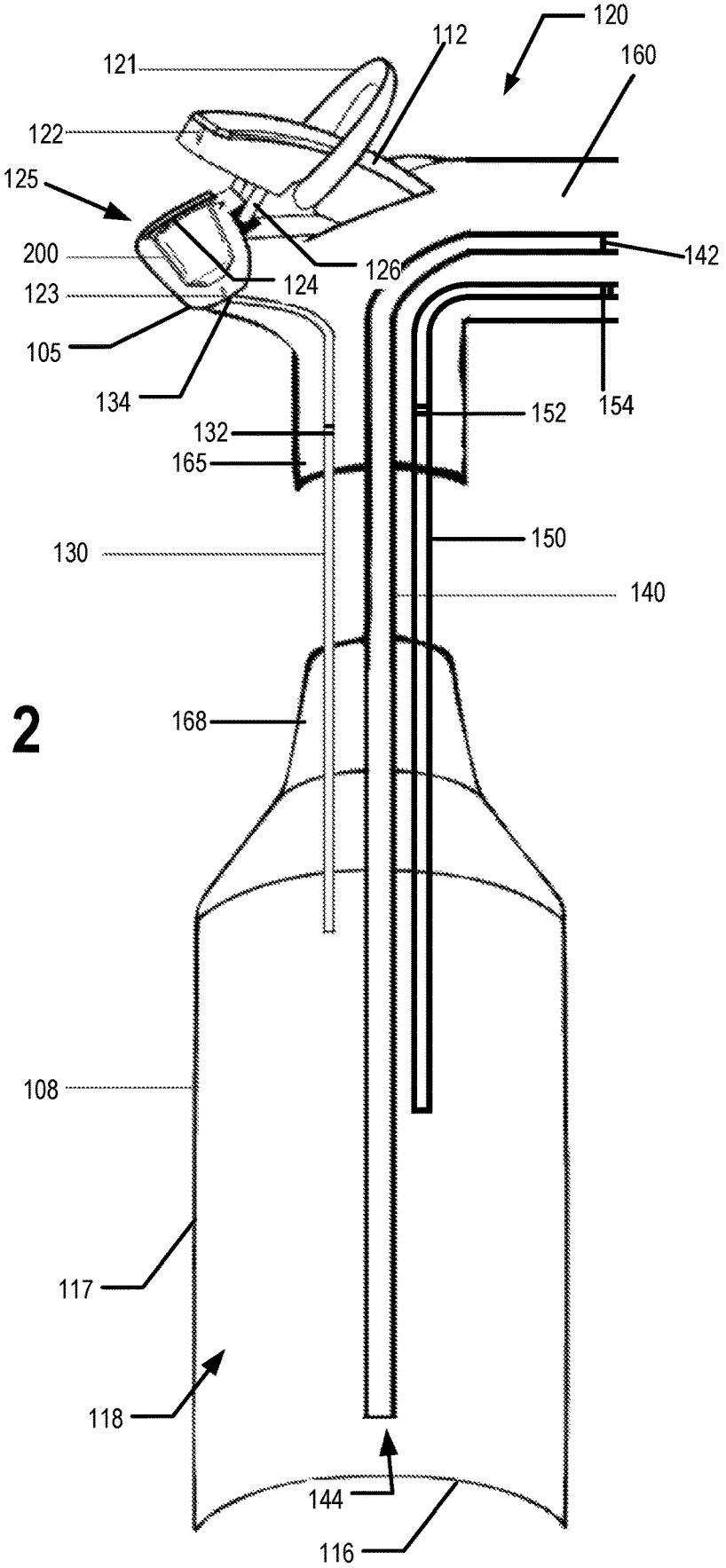

FIG. 2 provides a close up of the cleaning solution dispensing unit of the floor cleaning device, in accordance with an example embodiment.

Figure 3:
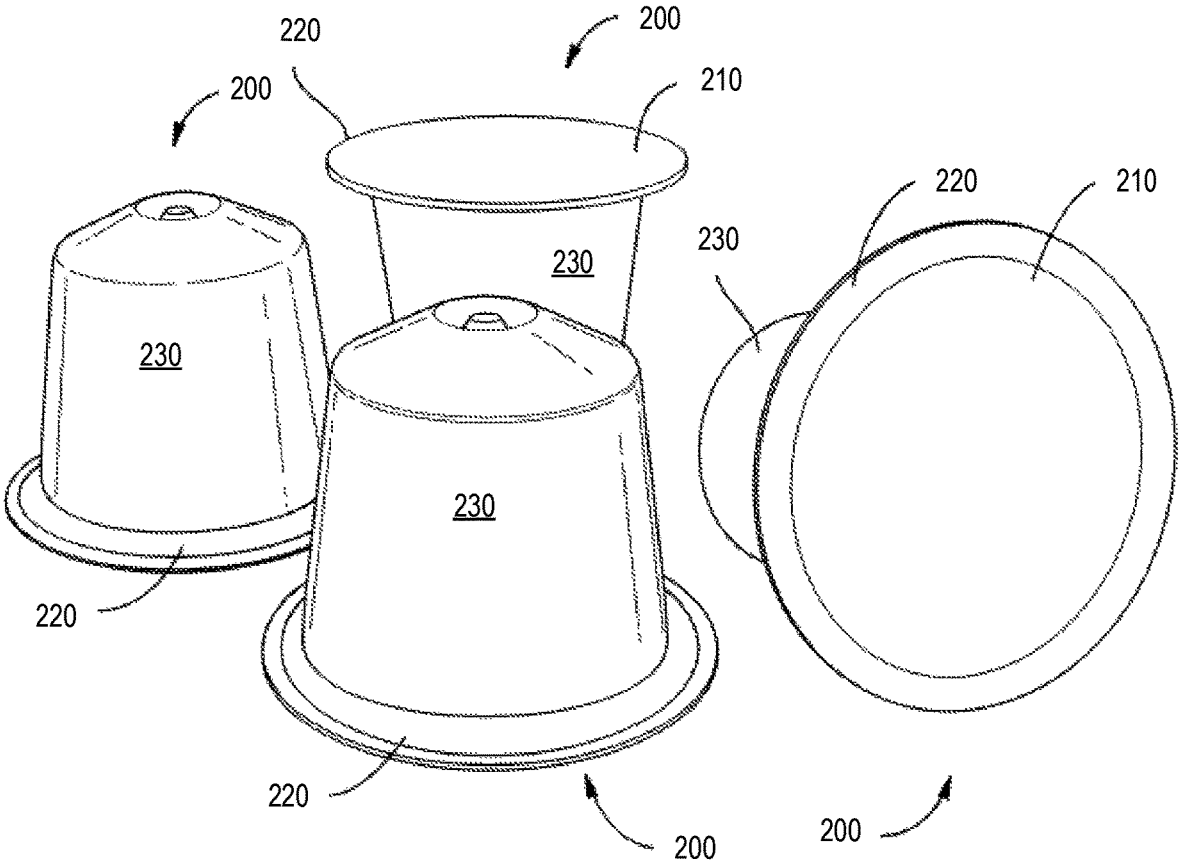

FIG. 3 provides perspective views of four cleaning capsules, in accordance with example embodiments.

Figure 4:
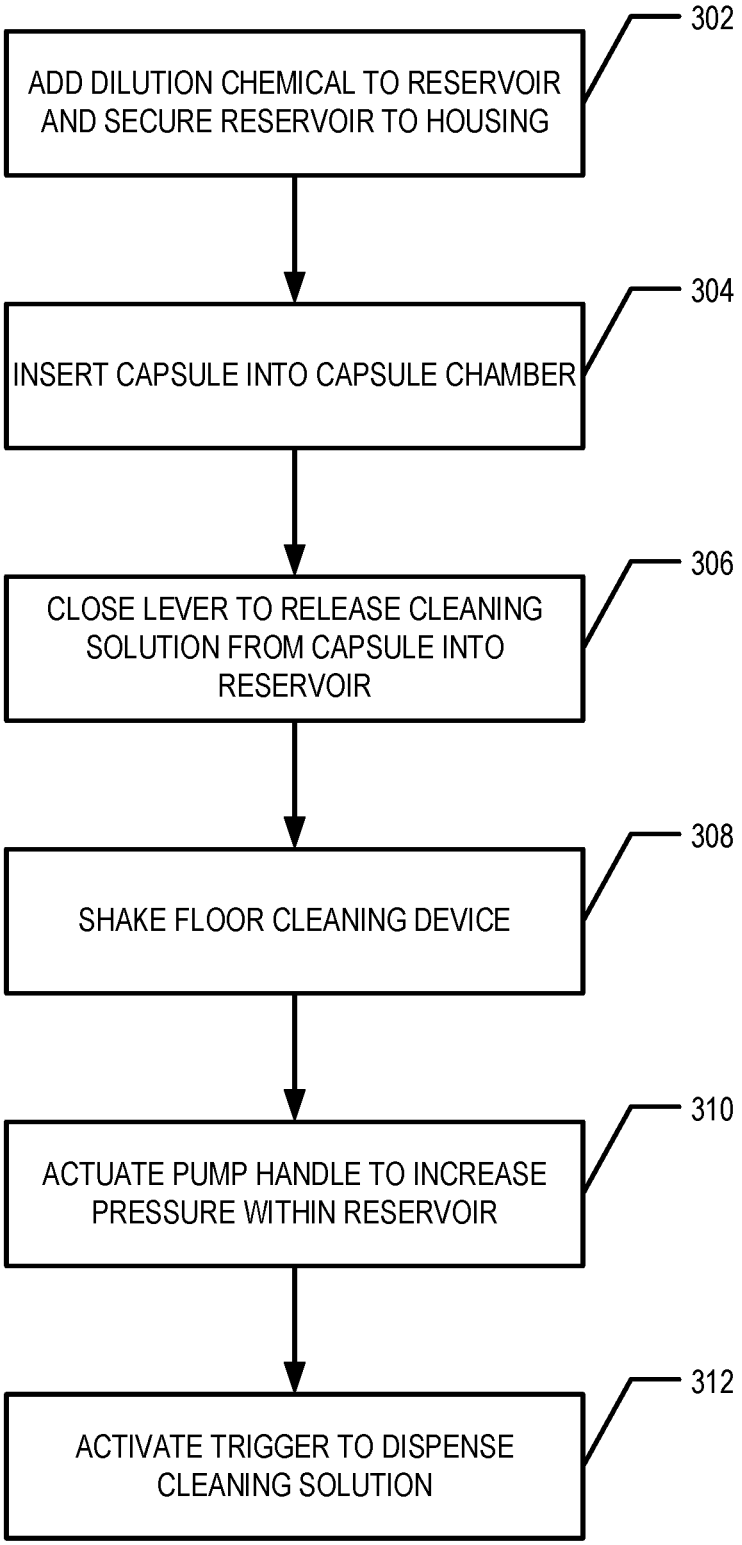

FIG. 4 provides a flowchart illustrating example processes for using a floor cleaning device of an example embodiment.

DETAILED DESCRIPTION OF EXAMPLE EMBODIMENTS

The present invention now will be described more fully hereinafter with reference to the accompanying drawing, in which one embodiment is shown. This invention may be embodied in many different forms and should not be construed as limited to the embodiments set forth herein; rather, these embodiments merely provide exemplary embodiments in keeping with the spirit of the invention. Like numbers refer to like elements throughout.

As shown in FIG. 1, in various embodiments, a floor cleaning device 100 comprises a rod or shaft 103. Attached to said rod 103 at a first end of the rod 103 is a handle 102 and a cleaning device head 110. In an example embodiment, the handle 102 is located at a proximate end of the rod 103 and the cleaning device head 110 is located at a distal end of the rod 103. In various embodiments, a cleaning solution dispensing unit 120 is also secured to the rod 103 between the proximate end of the rod 103 and the distal end of the rod 103. In various embodiments, a pump handle 104 and a corresponding pump 106 are secured to the rod 103 proximate the cleaning solution dispensing unit 120. In various embodiments, the pump 106 and pump handle 104 may be disposed and/or secured to the rod 103 at various locations along the rod 103. In an example embodiment of the invention, the rod 103 is made of a metal. However, the rod can be made of any appropriate material known to those with skill in the art (e.g., plastic, wood, and/or the like).

In various embodiments, the handle 102 of the floor cleaning device 100 is configured for a user to hold in their hand while using the floor cleaning device. For example, the user may hold the handle 102 in their hand and push the floor cleaning device 100 about the floor such that the cleaning head 110 (and/or a cleaning cloth/material 111 affixed to the cleaning head 110) is in contact with the floor (and/or other surface to be cleaned). In an example embodiment, the handle 102 also includes a trigger 101. In certain embodiments, when the trigger 101 is activated (e.g., pulled, pressed, and/or the like), the spray nozzle 109 opens, causing pressurized cleaning solution to be expelled through the spray nozzle as a mist, spray, and/or the like. Additionally, in example embodiments, the cleaning device utilizes a trigger. In other embodiments, the cleaning device utilizes a button or other trigger element to expel the cleaning fluid out of the spray nozzle.

In various embodiments, the floor cleaning device 100 comprises a cleaning solution dispensing unit 120. In various embodiments, the cleaning solution dispensing unit comprises a housing 160 and a removable reservoir 108. In various embodiments, the cleaning solution dispensing unit (e.g., the housing 160) comprises a capsule chamber 105 that allows cleaning capsules 200 to be placed into it. The capsule chamber 105 has a hole located at the distal end of the capsule chamber 105 to allow the concentrated cleaning liquid released from a cleaning capsule within the capsule chamber 105 to flow into the reservoir 108. Once in the reservoir 108, the concentrated cleaning liquid may mix with any dilution chemical in the reservoir 108. Said capsule chamber 105 also includes a lid 112. The closing of the lid 112 causes the puncture of the cleaning capsule 200 (e.g., via one or more puncture devices), which releases the cleaning liquid from the cleaning capsule 200 into the hole at the distal end of the chamber 105 and then into the reservoir 108.

In various embodiments, a pump 106 is secured to the rod 103 of the floor cleaning device 100. In an example embodiment, the pump 106 is configured to pressurize the reservoir. In an example embodiment, the pump 106 comprises a pump handle 104. The pump handle 104 is secured to the rod 103 such that the pump handle may be moved along a portion the length of the rod 103. The pump is configured such that movement of the pump handle 104 along at least a part of the portion of the length of the rod 103 causes air to be pumped into the reservoir 108, causing the reservoir 108 to be pressurized. For example, in an example embodiment, the movement of the pump handle 104 along the portion of the length of the rod 103 pressurizes the reservoir 108 by pushing air into an interior chamber 118 of the reservoir. In various embodiments, the pump 106 comprises a piston that causes air to be pushed into the reservoir 108. In example embodiments, as the pump handle 104 moves along a portion of the length of the rod, this action causes the piston in the pump 106 to force air into the reservoir 108. In example embodiments, this air moves through a one way flow valve 154, through a length of air flow tubing 150 (shown in FIG. 2). In example embodiments, the air continues to move through a water backflow prevention valve 152 and into the internal cavity 118 of the reservoir 108. In this manner, the cleaning fluid becomes pressurized. In other embodiments, the cleaning device utilizes a lever to pump air. Also, in various embodiments a pressure gauge allows users to know when the reservoir is sufficiently pressurized.

Example embodiments also include a dispensing tube 140 (shown in FIG. 2) that connects the reservoir 108 to the spray nozzle 109 located toward the distal end of the rod 103. In an example embodiment, the dispensing tube 140 is located within the rod 103. In certain embodiments, when the trigger 101 is activated (e.g., pulled, pressed, and/or the like), the spray nozzle 109 opens, causing the pressurized cleaning fluid to be expelled there through as a mist, spray, and/or the like. In various embodiments, cleaning solution is prevented from flowing though dispensing tube 140 by a pinch bar 142 that clamps the dispensing tube 140. In example embodiments, the cleaning solution is released by a spray nozzle 109 when the trigger 101 is activated. In example embodiments, the floor cleaning apparatus 100 contains a spring that causes the pinch bar 142 to remain closed when the trigger 101 is not being activated. When force is applied to the trigger 101 (e.g., by a user pushing, squeezing, pulling, and/or the like the trigger 101), the force is transferred to the pinch bar 142 acting in opposition to the aforementioned spring. When enough force is applied to the trigger 101, this force overcomes the force of the spring and the pinch bar 142 is lifted. In an example embodiment, when the pinch bar 142 is lifted and/or otherwise is made to decrease its compression of the dispensing tube 140, cleaning solution may be able to flow through the dispensing tube 140. For example, if the reservoir 108 is pressurized, the cleaning solution will flow through dispensing tube 140, which terminates at the spray nozzle 109. Other mechanisms of controlling the flow of cleaning solution through the dispensing tube 140, such as any number of standard valves, may be used in other embodiments. Other cleaning solution and/or pressure release means for regulating the cleaning solution flow through the dispensing tube 140 after the trigger 101 has been activated may also be used in certain embodiments.

Once the cleaning solution arrives at the spray nozzle 109, the cleaning solution is released through narrow openings on the spray nozzle 109 such that the cleaning solution is sprayed or misted onto a surface. A user can then move the cleaning device head 110 over the surface to clean the surface with the cleaning solution.

In various embodiments, a pivot connector 107 is used to secure the cleaning head 110 to the distal end of the rod 103 such that the cleaning head 100 may pivot, swivel, and/or rotate with respect to the distal end of the rod 103. In various embodiments, a cleaning cloth/material 111 is capable of being affixed to the cleaning device head 110.

FIG. 2 illustrates an example embodiment the cleaning solution dispensing unit 120. In an example embodiment, the cleaning solution dispensing unit 120 comprises a housing 160 that secures the cleaning solution dispensing unit 120 to the rod 103 of the floor cleaning device 100. In various embodiments, the housing comprises a capsule chamber 105 and an attachment portion 165. In various embodiments, the housing 160 and/or portions thereof may be made of metal, plastic, and/or other appropriate materials.

In various embodiments, the housing 160 may further include and/or house a reservoir pipette 130 configured to provide cleaning liquid from a cleaning capsule disposed within the capsule camber 105 into the interior cavity 118 of the reservoir 108. In various embodiments, the housing 160 further include and/or house at least a portion of a dispensing tube 140 that may extend from a mouth 144 disposed within the interior cavity 118 of the reservoir 108 (e.g., when the reservoir 108 is secured to the housing 160) to the spray nozzle 109. In an example embodiment, the dispensing tube 140 extends through the housing 160 into an interior passage of the rod 103. In an example embodiment, the dispensing tube 140 extends along an exterior of the rod 103 and/or in a channel on the exterior of the rod 103 from the cleaning solution dispensing unit 120 to the spray nozzle 109. In various embodiments, the housing 160 further includes and/or houses at least a portion of the air flow tubing 150. In an example embodiment, the air flow tubing 150 extends from the pump 106 into the interior cavity 118 of the reservoir 108 (e.g., when the reservoir 108 is secured to the housing 160). In an example embodiment, the flow of air through the air flow tubing 150 is controlled by a one way flow valve 154. In an example embodiment, the prevention of cleaning solution being sucked into the air flow valve is controlled through a backflow prevention valve 152. In an example embodiment, a one way valve, backflow prevention valve, and/or the like 132 may prevent cleaning liquid, dilution chemical, cleaning solution and/or air from exiting the interior cavity 118 of the reservoir 108 via the reservoir pipette 130.

The attachment portion 165 of the housing 160 is configured to secure the reservoir 108 to the housing 160. The attachment portion 165 may comprise threads or another mating mechanism for securing the reservoir 108 to the housing 165. For example, the attachment portion 168 of the reservoir 108 may comprise corresponding threads or another complimentary mating mechanism such that the reservoir 108 may be screwed and/or otherwise secured onto the housing 160.

In various embodiments, the housing 160 comprises a capsule chamber 105. The capsule chamber 105 portion of the housing 160 is configured to receive the cleaning capsule 200 therein and comprises one or more elements configured to puncture the cleaning capsule 200 to release the cleaning liquid contained within the cleaning capsule 200. In example embodiments, the capsule chamber 105 may comprise a seat 124 configured to have the ridge portion 220 of the cleaning capsule 200 engage therewith. The capsule chamber 105 may further comprise a cup receiving portion 125 configured to receive the cup portion 230 of a cleaning capsule 200 therein. The capsule chamber 105 may further comprise a mechanism for at least partially opening the cleaning capsule 200. For example, the capsule chamber 105 may comprise a first puncture pin 122 configured to at least partially open (e.g., puncture) a first surface of the cleaning capsule 200 (e.g., the lid portion 210 of the cleaning capsule 200) when the lever 121 is moved from an open position to a closed position on the housing 160. A second puncture pin 123 is configured to partially open (e.g., puncture) a second surface of the cleaning capsule 200 (e.g., the capsule cup 230) simultaneous to the first puncture of the first surface (e.g., lid portion 210) of the cleaning capsule 200. This is achieved upon moving of the lever 121 from an open position to a closed position when the cleaning capsule 200 is disposed within the cup receiving portion 125 and the ridge portion 220 of the cleaning capsule 200 is engaged with the seat 124. For example, when the lever 121 is in the open position, a lid 112 may be in a position such that the cup receiving portion 125 of the capsule chamber 105 is accessible (e.g., a cleaning capsule 200 may be inserted into and/or removed from the cup receiving portion 125). The lid 112 may be supported at least in part in the open position by one or more lever arm supports 126. When the lever 121 is in the closed position, the lid 112 is in a position such that the lid at least partially covers the cup receiving portion 125 such that cup receiving portion 125 is not accessible (e.g., a cleaning capsule 200 may not be inserted into and/or removed from the cup receiving portion 125). For example, the lid 112 may be coupled to the lever 121 (e.g., possibly via the lever arm support(s) 126) such that moving of the lever 121 from the open position to the closed position causes the lid 112 into a position where the lid 112 encloses and/or at least partially seals the cup receiving portion 125 of the capsule chamber 105. In various embodiments, the lid 112 is coupled to the lever 121 (e.g., possibly via the lever arm support(s) 126) such that moving the lever 121 from the closed position to the open position causes the lid 112 to move into a position where the cup receiving portion 125 is accessible (e.g., not closed or sealed such that a cleaning capsule may be inserted into and/or removed from the cup receiving portion 125).

In various embodiments, moving the lever 121 from the open position to the closed position causes the lid 112 to move to enclose and/or at least partially seal the capsule 200 within the capsule chamber 105. In an example embodiment, moving the lever 121 from the open position to the closed position may cause the capsule chamber 105 to move (e.g., on a hinge mechanism provided via the one or more lever arm supports 126 and/or the like) such that the opening of the cup receiving portion 10 moves toward the lever arm 121. For example, the capsule chamber 105 may move such that a ridge portion 220 of the cleaning capsule 200 disposed within the capsule chamber 105 (e.g., such that the ridge portion 220 is proximate and/or engages seat 124) engages a lip of the lid 112. For example, the lid 112 and/or the capsule chamber 105 may move (e.g., in a hinged manner) in response to movement the lever 121, in various embodiments.

In various embodiments, the first puncture pin 122 is disposed on and/or coupled to the lid 112 such that moving the lever 121 from the open position to the closed position causes the first puncture pin 122 to engage and puncture a first surface (e.g., the capsule lid 210) of a cleaning capsule 200 disposed within the cup receiving portion 125. The second puncture pin 123 may be disposed in the cup receiving portion 125. In an example embodiment, the moving of the lever 121 from the open position to the closed position causes a lip of the lever lid 112 to engage the ridge portion 120 of the cleaning capsule disposed within the cup receiving portion 125, causing the cup 230 to be pressed against the second puncture pin 123 within the cup receiving portion 125 such that the second puncture pin 123 punctures the cup 230. In an example embodiment, the second puncture pin is coupled to the reservoir pipette 130 such that cleaning solution may vacate the cleaning capsule 200 via the puncture in the cup 230 caused by engagement of the second puncture pin 123 with the cup 330 and enter the reservoir pipette 130. For example, the second puncture pin 123 may be a hollow puncture pin affixed to a mouth 132 of the reservoir pipette 130. The reservoir pipette 130 facilitates the flow of cleaning liquid from the cleaning capsule 200 to the interior cavity 118 of the reservoir 108 for dilution, mixing, and dispensing.

In example embodiments, the cleaning solution dispensing unit 120 comprises a reservoir 108. The reservoir 108 may comprise an internal cavity 118, and an attachment portion 168. In example embodiments, the attachment portion 168 is configured to secure the reservoir 108 to the housing 160. The internal cavity 118 is a hollow portion of the reservoir 108 configured to receive cleaning liquid, dilution chemical, and/or cleaning solution therein and provide the cleaning solution to the mouth 142 of the dispensing tube 140 such that the cleaning solution may be dispensed via the nozzle 109. In example embodiments, a line on the reservoir container instructs and/or illustrates to users how much dilution chemical (e.g., water, vinegar, and/or the like) to put into the internal cavity 118 of the reservoir 108. In example embodiments, the reservoir 108 is made of a metal. However, any appropriate material known by those with skill in the art can be used to make the reservoir 108 (e.g., plastic, glass, and/or the like).

In example embodiments, the internal cavity 118 may comprise a hollow portion within the reservoir 108 configured for receiving cleaning liquid therein from the cleaning capsule 200 (e.g., via the reservoir pipette 130). For example, the cleaning capsule 200 may provide cleaning liquid to the internal cavity 118. The internal cavity 118 may contain the cleaning liquid therein. For example, the internal cavity 118 may be configured to receive and/or contain a dilution chemical (e.g., water, vinegar, and/or the like) therein for mixing with cleaning liquid provided by the cleaning capsule 200. In example embodiments, the internal cavity 118 may be configured to have a dilution chemical (e.g., water, vinegar, and/or the like) and cleaning liquid mixed therein to provide a cleaning solution.

The internal cavity 118 may be defined by an end surface 116 and a wall 117. In an example embodiment, the wall 117 may be a cylindrical shell (e.g., having an annular cross-section that is round, oval, square, rectangular, polygon, and/or the like where the cross-section is taken in a plane generally and/or substantially parallel to the end surface 116) closed at one end by the end surface 116. The end surface 116 may define one end of the hollow portion of the reservoir 108. Wall 117 may join the end surface 116 to the attachment portion 168. The interior of the wall 117 and the end surface 116 may define the hollow portion of the internal cavity 118. In various embodiments, the end surface 116 is planar, convex, concave, and/or a combination thereof. In example embodiments, the mouth 144 of the dispensing tube 140 may be located directly below the attachment portion 168 proximate the center of the bottom surface 116, as shown in FIG. 2.

In example embodiments, the attachment portion 168 of the reservoir 108 comprises a mechanism for securing the reservoir 108 to the housing 160. For example, the attachment portion 168 of the reservoir 108 may comprise threads that correspond to threads on the attachment portion 165 of the housing 160 and/or another mating mechanism that corresponds to (e.g., is configured to mate with) the mating mechanism of the attachment portion 160 of the housing 160.

FIG. 3 provides various views of an example embodiment of a cleaning capsule 200. In an example embodiment, a cleaning capsule 200 is configured to hold cleaning liquid therein. In an example embodiment, the cleaning capsule 200 comprises a first surface and a second surface. For example, in an example embodiment, the first surface is at least a part of a lid portion 210 of the cleaning capsule 200 and the second surface is at least a portion of a cup 230 of the cleaning capsule 200. The cup 230 is configured to hold cleaning liquid therein. The lid portion 210 is configured to seal the cleaning liquid within the cup 230. The cleaning capsule 200 may further comprise a ridge portion 220. The ridge portion 220 may be where the lid portion 210 is secured to the cup 230. The ridge portion 220 may further be configured to assist in securing the cleaning capsule 200 into the capsule chamber 105 of the housing 160. For example, the ridge portion 220 may be configured to aid in the alignment of the cleaning capsule within the capsule chamber 105 of the cleaning solution dispensing unit 120 or be secured within the capsule chamber 105 or other portion of the cleaning solution dispensing unit 120.

In various embodiments, the cup portion 230 is configured to hold one to two ounces of cleaning liquid. In an example embodiment, the cleaning capsule 200 is configured to contain 0.5 to 2 ounces of the cleaning liquid. In an example embodiment, the cleaning capsule 200 is configured to contain 1.5 to 3 ounces of the cleaning liquid. In other embodiments, smaller or larger volumes of cleaning liquid may be accommodated by the cup portion 230 of the cleaning capsule 200. In an example embodiment, the cup portion 230 is configured to hold a single cleaning session worth of cleaning solution. For example, the cup portion 230 may be configured to hold enough cleaning solution to clean one room, one hundred square feet, one hundred fifty square feet, two hundred square feet, four hundred square feet, five hundred square feet, a thousand square feet, and/or the like. In various embodiments, the cup portion 230 may be configured to hold between about 10-100 doses (each dose corresponding to a single actuation of the trigger 101 to dispense a dose of cleaning solution through the nozzle 109). In an example embodiment, the cup portion 230 may be configured to hold approximately 20 doses (e.g., 15 to 25 doses). In example embodiments, the cleaning liquid may be a concentrated cleaning liquid. In some embodiments, the concentrated cleaning liquid may be of a cleaning solution strength that is ready to use. In some embodiments, the cleaning liquid may be intended to be diluted (e.g., by putting water or another dilution chemical into the reservoir 108 for mixing with the cleaning liquid to form a cleaning solution). In various embodiments, the cleaning liquid may be a wood cleaning liquid, tile cleaning liquid, laminate cleaning liquid, pet stain cleaning liquid, carpet cleaning liquid, marble cleaning liquid, metal cleaning liquid, leather cleaning liquid, and/or the like.

In example embodiments, the cup portion 230 may be color-coded based on the cleaning liquid type contained therein. In example embodiments, the cup portion 230 may be made of aluminum, another metal, plastic, cardboard, paperboard, a natural post-consumer recycled material, or another appropriate material and/or combination thereof.

In example embodiments, the lid portion 210 may be configured to seal the cleaning solution within the cup portion 230. For example, the cup portion 230 may comprise an opening and the lid portion 210 may seal the opening. In example embodiments, the lid portion 210 comprises aluminum (e.g., a rigid sheet of aluminum and/or aluminum foil), another metal, plastic, cardboard, paperboard, or another appropriate material and/or combination thereof. In an example embodiment, the lid portion 210 may be a foil lid. The lid portion 210 may have information/data printed thereon. For example, the printed information/data may comprise a cleaning solution type indicator, branding, and/or other printed information and/or indicia. The printed information/indicia may be on an exterior surface of the lid portion 310 opposite the side of the lid portion 210 that directly faces the opening of the cup portion 230.

In example embodiments, the lid portion 210 may be sealed to the cup portion 230 to a ridge portion 220 surrounding the opening of the cup portion 230. The ridge portion 220 may be configured to assist in securing the cleaning capsule 200 into the capsule chamber 105. For example, when the cleaning capsule 200 is properly inserted into the capsule chamber 105, the ridge portion 220 may be configured to abut a seat 124 within the capsule chamber 105 of the housing 160. When the lever 121 is in a closed position, the ridge portion 220 may be engaged by both a lip of the lid 112 and a seat 124 within the capsule chamber 105, thereby holding the cleaning capsule 200 in place with respect to components of the housing 160.

FIG. 4 provides a flowchart that illustrates various processes that may be completed to dispense a cleaning solution from a floor cleaning device 100 and/or to clean a floor using the floor cleaning device 100. Starting at block 302, the reservoir 108 is secured to the housing 160. For example, a user may mate the mating mechanism(s), threads, and/or the like of the attachment portion 168 of the reservoir 108 with the corresponding mating mechanism(s), threads, and/or the like of the attachment portion 165 of the housing 160. In an example embodiment, a user may add a dilution chemical (e.g., water, vinegar, and/or the like) to the internal cavity 118 of the reservoir 108 prior to securing the reservoir 108 to the housing 160. For example, the internal cavity 118 and/or wall 117 and/or reservoir 108 may include a fill line and the user may add the dilution chemical to the internal cavity 118 until the dilution chemical reaches the fill line. Various other mechanisms may be used to guide a user in adding an appropriate amount of the dilution chemical (e.g., water, vinegar, and/or the like) to the internal cavity 118 of the reservoir 108 in various embodiments.

At block 304, with the lever 121 in the open position, a cleaning capsule 200 is inserted into a capsule chamber 105 of the housing 160. For example, a user may insert a cleaning capsule 200 into the capsule chamber 105 of the housing 160 such that the cup portion 230 of the cleaning capsule 200 is within the cup receiving portion 125 and the ridge portion 220 of the cleaning capsule 200 rests against and/or proximate a seat 124 of the capsule chamber 105. For example, the cup portion 230 may be pressed against and/or proximate a second puncture pin 123 of the capsule chamber 105. In some embodiments, the user may press the cleaning capsule 200 into the capsule chamber 105 until the second puncture pin 123 punctures the cup portion 230 to create a puncture hole. In other embodiments, the cleaning capsule 200 may rest against and/or be positioned in the vicinity of the second puncture pin 123 but not actually engaged with the second puncture pin 123 at this point.

At block 306, the lever 121 is moved from an open position to a closed position. In example embodiments, moving the lever 121 from the open position to the closed position causes the lid 112 coupled to the lever 121 to enclose and/or at least partially seal the cup receiving portion 125 of the capsule chamber 105. For example, moving the lever 121 from the open position to the closed position causes the lid 112 to secure the cleaning capsule 200 within the capsule chamber 105. For example, a lip of the lid 112 may engage the lid 210 side of the ridge portion 220 of the cleaning capsule 200 to press the opposite side of the ridge portion 220 (e.g., the cup portion 230 side) against and/or into engagement with the seat 124 of the capsule chamber 105. Moving of the lever 121 from the open position to the closed position may further cause the first puncture pin 122 to open (e.g., puncture) the lid portion 210. Thus, a puncture hole may be created in the lid portion 210. In an example embodiment, the puncture hole in the lid portion 210 may act as a vent hole for evacuating the cleaning liquid from the cleaning capsule 200 via a puncture hole in the cup portion 330. If the second puncture pin 123 has not yet punctured the cup portion 230, closing of the lever 121 may cause the second puncture pin 123 to puncture the cup portion 230. Thus, the cleaning liquid may be infused, released, provided, and/or the like into the reservoir pipette 130. In some embodiments, the cleaning liquid is not infused, released, provided and/or the like into the reservoir pipette 130 until both the first puncture pin 122 and the second puncture pin 123 have punctured the cleaning capsule 200. In various embodiments, the cleaning liquid flows through the mouth 134 of the reservoir pipette 130, through the reservoir pipette 130, and into the interior cavity 118 of the reservoir 108. For example, the second puncture pin 123 may be hollow and coupled to the mouth 134 of the reservoir pipette 130 such that the cleaning liquid may flow, once the at least the second puncture pin 123 has punctured the cup portion 230 of the cleaning capsule 200, through the second puncture pin 123, through the mouth 134 of the reservoir pipette, and through the reservoir pipette 130 into the interior cavity 118 of the reservoir 108.

In an example embodiment, as noted above, before securing the reservoir 108 to the housing 160, the interior cavity 118 of the reservoir 108 may be at least partially filled with a dilution chemical (e.g., water, vinegar, and/or the like). Thus, when the cleaning liquid is provided to the interior cavity 118 of the reservoir 108 (as a result of the lever 121 being moved from the open position to the closed position), the resulting cleaning solution in the interior cavity 118 of the reservoir 108 may be a diluted and/or deconcentrated cleaning liquid such as a regular or normal strength cleaning solution. For example, the cleaning liquid provided by the cleaning capsule 200 is provided to the interior cavity 118 of the reservoir 108 through the reservoir pipette 130, the cleaning liquid may be diluted to a less concentrated cleaning solution.

At block 308, the floor cleaning device 100 may be shaken, stirred, turned, twirled, swirled, and/or the like. For example, the user may shake, stir, turn, twirl, swirl, and/or the like the floor cleaning device 100. In example embodiments, shaking the floor cleaning device 100 may cause at least a portion of any cleaning liquid still residing in the cleaning capsule 200 to be infused, released, and/or provided to the interior cavity 118 through the reservoir pipette 130. In another example, shaking the floor cleaning device 100 may cause the cleaning liquid to mix generally uniformly with any dilution chemical (e.g., water, vinegar, and/or the like) within the interior cavity 118 such that the resulting cleaning solution is a relatively uniform cleaning solution.

At block 310, the pump handle 104 may be actuated to cause air to be pumped into the interior cavity 118 of the reservoir (e.g., via the air flow tube 150) to increase the pressure within the interior cavity 118 of the reservoir 108. For example, user may move the pump handle 104 back and forth along the portion of the length of the rod 103 one or more times to cause air to be pumped into the interior cavity 118 of the reservoir 108, causing the interior cavity 118 to become pressurized. For example, a user may pressurize the interior cavity 118 of the reservoir 108 using the pump handle 104 to cause the pump 106 to pump air into the interior cavity 118.

At block 312, the trigger 101 may be activated to cause the cleaning solution to be dispensed. For example, the user may activate the trigger 101 by pulling, pushing, pressing, pumping, squeezing, or otherwise activating the trigger 101. When the trigger 101 is activated, a pinch bar 142 that clamps the dispensing tube 140 (and/or another mechanism used to prevent cleaning solution and/or air from leaving the interior cavity 118 via the dispensing tube 140) may be released such that cleaning solution is pushed out through the dispensing tube 140 (e.g., due to the pressurization of the interior cavity 118). For example, activating the trigger 101 may cause and/or allow cleaning solution to exit the interior cavity 118 through the dispensing tube 140 and be dispensed (e.g., sprayed onto the floor and/or other surface to be cleaned) via the spray nozzle 109. Thus, activating the trigger 101 causes cleaning solution to be dispensed from the interior cavity 101, through dispensing tube 140, and out of the nozzle 109. In various embodiments, a user activates the trigger 101 (e.g., pushing, pressing, squeezing, and/or the like the trigger 101) to cause the trigger 101 to enter a compressed state. When the user stops activating the trigger 101 (e.g., releases the trigger 101), a spring and/or the like may cause the trigger 101 to return to a decompressed state from the compressed state such that the trigger 101 is ready to be activated again. Similarly, when the user stops activating the trigger 101 (e.g., releases the trigger 101) a spring coupled to the pinch bar 142 may cause the pinch bar to clamp the dispensing tube 140 such that the dispensing of the cleaning solution via the nozzle 109 is ceased.

The operations of blocks 310 and 312 may be repeated as necessary for cleaning the floor and/or other surface. When the supply of cleaning solution within the interior cavity 118 is depleted, the operations of blocks 302-308 may be repeated to prepare additional cleaning solution for additional cleaning of the floor and/or other surface.

CONCLUSION

Many modifications and other embodiments of the invention set forth herein will come to mind to one skilled in the art to which this invention pertains having the benefit of the teachings presented in the foregoing descriptions and the associated drawing. Therefore, it is to be understood that the invention is not to be limited to the specific embodiments disclosed and that modifications and other embodiments are intended to be included within the scope of the claims. Although specific terms are employed herein, they are used in a generic and descriptive sense only and not for purposes of limitation.

That which is claimed:

1. A floor cleaning device comprising:

a rod, the rod extending between a proximate end and a distal end;

a handle comprising a trigger secured to the proximate end of the rod;

a cleaning head secured to the distal end of the rod;

a nozzle disposed proximate the distal end of the rod; and a cleaning solution dispensing unit secured to the rod between the proximate end and the distal end, wherein the cleaning solution dispensing unit comprises a housing forming an external surface of the cleaning solution dispensing unit and comprising a capsule chamber configured to receive a cleaning capsule therein, and a reservoir removably secured to the housing, wherein the capsule chamber is configured to provide a cleaning liquid stored within the cleaning capsule to an interior cavity of the reservoir;

wherein, when the trigger is activated, cleaning solution is dispensed through the nozzle via a dispensing tube extending from the cleaning solution dispensing unit to the nozzle.

2. The floor cleaning device of claim 1, further comprising a pump secured to the rod between the proximate and distal ends of the rod, the pump configured to pressurize the internal cavity.

3. The floor cleaning device of claim 2, further comprising a pump handle secured to the rod such that the pump handle is movable along a portion of a length between the proximate and distal ends of the rod, wherein movement of pump handle along at least a part of the portion of the length causes the pump to pump air into the internal cavity.

4. The floor cleaning device of claim 2, further comprising a pressure gauge configured to indicate a level of pressure within the interior cavity.

5. The floor cleaning device of claim 2, further comprising an air flow tube configured to enable the pump to provide air to the interior cavity.

6. The floor cleaning device of claim 5, wherein the air flow tube comprises at least one of a one way flow valve or a backflow prevention valve to prevent at cleaning solution, dilution chemical, cleaning liquid, and/or air from exiting the interior cavity via the air flow tube.

7. The floor cleaning device of claim 1, wherein the interior cavity is configured to receive a dilution chemical configured to dilute the cleaning liquid, and wherein the dilution chemical is dispensed from the reservoir portion through the dispensing tube and out of the nozzle with the cleaning liquid.

8. The floor cleaning device of claim 7, wherein the dilution chemical is water.

9. The floor cleaning device of claim 1, wherein the housing comprises a lid configured to be moveable between an open position and a closed position, wherein when the cleaning capsule is positioned within the capsule chamber and the lid is moved from the open position to the closed position, the cleaning solution is provided to the interior cavity of the reservoir.

10. The floor cleaning device of claim 9, wherein the lid is coupled to a lever such that the lid is moveable between an open position and a closed position via movement of the lever between corresponding open and closed positions.

11. The floor cleaning device of claim 9, wherein the housing further comprises a reservoir pipette and when the lid is moved from the open position to the closed position, the cleaning liquid is provided to the interior cavity via the reservoir pipette.

12. The floor cleaning device of claim 11, wherein the reservoir pipette comprises a one way valve configured to prevent cleaning solution, dilution chemical, cleaning liquid, and/or air from exiting the interior cavity via the reservoir pipette.

13. The floor cleaning device of claim 9, wherein the lid is coupled to a first puncture pin configured to puncture a first surface of the cleaning capsule positioned within the capsule chamber when the lid is moved from the open position to the closed position.

14. The floor cleaning device of claim 9, wherein the capsule chamber comprises a second puncture pin configured to puncture a second surface of the capsule positioned within the capsule chamber.

15. The floor cleaning device of claim 14, wherein the puncturing of the second surface by the second puncture pin is caused by the lid being moved from the open position to the closed position.

16. The floor cleaning device of claim 14, wherein the second puncture pin is coupled to a reservoir pipette such that cleaning liquid exiting the capsule via a puncture generated by the second puncture pin enters a mouth of the reservoir pipette, wherein the reservoir pipette is configured to provide the cleaning liquid to the interior cavity.

17. The floor cleaning device of claim 14, wherein the second puncture pin is hollow.

18. The floor cleaning device of claim 1, further comprising a pinch bar configured to clamp the dispensing tube when the trigger is not activated to prevent the dispensing of cleaning solution through the dispensing tube through the nozzle and configured to release the dispensing tube when the trigger is activated to permit the dispensing of cleaning solution through the dispensing tube through the nozzle.

19. The floor cleaning device of claim 1, wherein the cleaning head is secured to the rod via a pivot connector such that the cleaning head may pivot or swivel with respect to the distal end of the rod.

* * * * *